US010144909B2

(12) United States Patent
Tong et al.

(10) Patent No.: US 10,144,909 B2
(45) Date of Patent: Dec. 4, 2018

(54) FABRIC CARE PELLETS AND METHODS

(75) Inventors: Sun Tong, Shanghai (CN); Randolph Sui, Shanghai (CN); Michael P. Gao, Beijing (CN); Yurong Cao, Shanghai (CN)

(73) Assignee: Dow Global Techlologies LLC, Midland, MI (US)

( * ) Notice: Subject to any disclaimer, the term of this patent is extended or adjusted under 35 U.S.C. 154(b) by 426 days.

(21) Appl. No.: 14/118,619

(22) PCT Filed: Jun. 17, 2011

(86) PCT No.: PCT/CN2011/075845
§ 371 (c)(1),
(2), (4) Date: Jan. 27, 2014

(87) PCT Pub. No.: WO2012/171210
PCT Pub. Date: Dec. 20, 2012

(65) Prior Publication Data

US 2014/0173834 A1 Jun. 26, 2014

(51) Int. Cl.

| | |
|---|---|
| ***C11D 3/50*** | (2006.01) |
| ***C11D 3/28*** | (2006.01) |
| ***C11D 17/00*** | (2006.01) |
| ***C11D 3/12*** | (2006.01) |
| ***C11D 3/37*** | (2006.01) |
| ***C11D 17/06*** | (2006.01) |
| ***D06M 15/263*** | (2006.01) |
| ***D06M 15/333*** | (2006.01) |
| ***D06M 15/507*** | (2006.01) |

(52) U.S. Cl.
CPC ..... *C11D 17/0039* (2013.01); *C11D 3/124* (2013.01); *C11D 3/126* (2013.01); *C11D 3/128* (2013.01); *C11D 3/1233* (2013.01); *C11D 3/28* (2013.01); *C11D 3/3715* (2013.01); *C11D 3/3753* (2013.01); *C11D 3/3761* (2013.01); *C11D 3/3788* (2013.01); *C11D 17/0034* (2013.01); *C11D 17/0047* (2013.01); *C11D 17/06* (2013.01); *C11D 17/065* (2013.01); *D06M 15/263* (2013.01); *D06M 15/333* (2013.01); *D06M 15/507* (2013.01)

(58) Field of Classification Search
CPC ..... C11D 3/50; C11D 3/28
USPC ..... 510/101
See application file for complete search history.

(56) References Cited

U.S. PATENT DOCUMENTS

| | | | | |
|---|---|---|---|---|
| 5,925,195 | A | 7/1999 | King et al. | |
| 6,221,928 | B1 * | 4/2001 | Kozma | C08F 255/00 521/134 |
| 6,450,633 | B1 | 9/2002 | Kronzer | |
| 7,494,512 | B2 | 2/2009 | Brown et al. | |
| 7,879,191 | B2 | 2/2011 | Dyer et al. | |
| 8,512,515 | B2 | 8/2013 | Dyer et al. | |
| 2005/0113267 | A1 | 5/2005 | Popplewell et al. | |
| 2005/0176599 | A1 | 8/2005 | Bergquist et al. | |
| 2005/0183206 | A1 | 8/2005 | Brown et al. | |
| 2007/0148432 | A1 * | 6/2007 | Baker | A61L 15/425 428/304.4 |
| 2008/0153736 | A1 * | 6/2008 | Elder | A61K 8/06 512/4 |
| 2008/0153944 | A1 | 6/2008 | Cheng et al. | |
| 2008/0271259 | A1 | 11/2008 | Wang | |
| 2009/0004234 | A1 | 1/2009 | Keesler et al. | |
| 2009/0163399 | A1 | 6/2009 | Corradini et al. | |
| 2009/0217461 | A1 | 9/2009 | Burkinshaw et al. | |
| 2009/0275690 | A1 * | 11/2009 | Weaver | C08G 18/69 524/507 |
| 2010/0093598 | A1 | 4/2010 | Davio et al. | |
| 2010/0143652 | A1 | 6/2010 | Stockton et al. | |
| 2010/0203291 | A1 | 8/2010 | Dyer et al. | |
| 2010/0212849 | A1 | 8/2010 | Smith et al. | |
| 2010/0234263 | A1 | 9/2010 | Wasan et al. | |
| 2011/0124544 | A1 | 5/2011 | He Mengtao et al. | |
| 2011/0296628 | A1 | 12/2011 | Jenkins et al. | |
| 2012/0048299 | A1 | 3/2012 | Jenkins et al. | |

FOREIGN PATENT DOCUMENTS

| | | | | |
|---|---|---|---|---|
| EP | 130639 | A1 | 1/1985 | |
| EP | 171215 | A1 | 2/1986 | |
| EP | 523950 | A1 | 1/1993 | |
| EP | 1533365 | A1 | 5/2005 | |
| JP | 2008-050411 | A | 3/2008 | |
| JP | WO 2011071079 | A1 * | 6/2011 | A61K 8/361 |
| WO | 2006040539 | A1 | 4/2006 | |
| WO | 2011034883 | A2 | 3/2011 | |

OTHER PUBLICATIONS

Google Patents translation of WO 2011071079 A1. 2011.*
First Office Action from Chinese Patent Application No. 201180071702.3 dated Oct. 10, 2014.
Supplementary European Search Report from European Application No. 11867986 dated Sep. 1, 2014.
Chokshi, et al., Hot-Melt Extrusion Technique: A Review, Iranian Journal of Pharmaceutical Research, vol. 3, No. 1, 2004, pp. 3-16.

* cited by examiner

*Primary Examiner* — Gregory R Delcotto
*Assistant Examiner* — Preeti Kumar
(74) *Attorney, Agent, or Firm* — Raef M. Shaltout

(57) ABSTRACT

Described are fabric care pellets comprising an amphiphilic polymer, preferably an ethylene acrylic acid copolymer, a surfactant, and a filler, wherein the pellet contains 30 wt % to 90 wt % amphiphilic polymer, preferably ethylene acrylic acid copolymer, and methods of making and using the same.

16 Claims, No Drawings

FABRIC CARE PELLETS AND METHODS

CROSS REFERENCE TO RELATED APPLICATIONS

This application is a 35 USC § 371 national phase filing of PCT/CN2011/075845 filed Jun. 17, 2011.

FIELD

The present application relates to fabric care pellets and methods of making and using the same.

BACKGROUND

Fabric care, particularly cleaning, can be divided into two basic theoretical approaches, namely, water-based cleaning or dry/powder cleaning. Dry cleaning can be perceived by customers as raising certain concerns regarding solvent residue and volatile organic content (VOC), however, water-based cleaning also has disadvantages.

For one example, in a conventional water cleaning process, significant amounts of clean water are required for both washing and rinsing cycles. Typically, the weight ratio of consumed water to fabric is around 12:1 to 20:1. As can be appreciated, this is a challenge for clean water supply infrastructure, especially those facing water shortage issues. Moreover, many forecast water-saving as a mega-trend in sustainability. Accordingly, consumers desire to conserve water is likely to increase over time.

Thus, it is desirable to provide a fabric care composition that achieves excellent washing performance with water, whilst requiring less water than conventional water-based cleaning processes. It is also desirable to provide an efficient and environmentally friendly cleaning method compared to conventional cleaning processes.

SUMMARY

In one embodiment, the present invention provides a fabric care pellet, comprising an amphiphilic polymer, preferably ethylene acrylic acid copolymer, a surfactant, and a filler, wherein the pellet contains 30% to 90% by weight amphiphilic polymer, preferably ethylene acrylic acid copolymer, based upon the weight of the pellet.

In another embodiment, the present invention provides a method of cleaning fabric, comprising contacting the fabric with a fabric care pellet, comprising amphiphilic polymer, preferably ethylene acrylic acid copolymer, and a filler, wherein the pellet contains 30% to 90% by weight amphiphilic polymer, preferably ethylene acrylic acid copolymer, based upon the weight of the pellet.

In another embodiment, the present invention provides a method of conserving water when laundering fabrics, comprising contacting the fabric with a fabric care pellet, comprising amphiphilic polymer, preferably ethylene acrylic acid copolymer, and a filler, wherein the pellet contains 30% to 90% by weight amphiphilic polymer, preferably ethylene acrylic acid copolymer, based upon the weight of the pellet.

DETAILED DESCRIPTION

In one embodiment, the present invention provides a fabric care pellet, comprising an amphiphilic polymer, preferably ethylene acrylic acid copolymer, a surfactant, and a filler, wherein the pellet contains 30% to 90% by weight amphiphilic polymer, preferably ethylene acrylic acid copolymer, based upon the weight of the pellet.

"Fabric care" relates to compositions to be applied to fabric for cleaning or treating after use. Fabric is used in the broad sense of textiles, e.g. natural fibers, synthetic fibers or combination therefore.

"Pellet" refers to particles with an average particle size of 1 mm to 1000 mm, preferably 10 mm to 500 mm. The average particle size of the pellet in the invention may be 1 mm or more, preferably 2 mm or more, more preferably 2.5 mm or more, or up to or less than 10 mm, preferably up to or less than 8 mm, more preferably up to or less than 5 mm. In one embodiment, the pellet has porous structure. The pores may be present on the surface of the pellet, in the bulk of the pellet or both on the surface and in the bulk of the pellets. The density of the porous pellet may be 0.2 $g/cm^3$ or more, preferably 0.7 $g/cm^3$ or more, more preferably 0.9 $g/cm^3$ or more, or up to or less than 1.5 $g/cm^3$, preferably up to or less than 1.1 $g/cm^3$, more preferably up to or less than 1 $g/cm^3$.

"Amphiphilic polymer" means a polymer or interpolymer having both hydrophilic units and hydrophobic units. "Interpolymer" means a polymer prepared by the polymerization of at least two different monomers. This generic term includes copolymers, usually employed to refer to polymers prepared from two different monomers, and polymers prepared from more than two different monomers, e.g., terpolymers, tetrapolymers, etc. "Hydrophilic" typically means a portion that interacts intramolecularly with water and other polar molecules. Examples of hydrophilic units include, for example, carboxylic acids, their anhydrides, their salts, their alkyl esters or mixtures thereof. The carboxylic acids may include, for example, monocarboxylic acid, dicarboxylic acid, or mixtures thereof. Examples of the carboxylic acids include, for example, acrylic acid, methacrylic acid, maleic acid, lactic acid, vinyl acid, or mixtures thereof. In one embodiment, the hydrophilic units comprise the carboxylic acids, their anhydrides, their alkyl esters, their salts or mixtures in the amount of 5 wt % or more, preferably 10 wt % or more, or up to or less than 40 wt %, preferably up to or less than 20 wt % based upon the weight of the amphiphilic polymer. "Hydrophobic" typically means a portion that interacts preferentially with oils or fats rather than aqueous media.

In one embodiment, the pellet contains 30 wt % or more, preferably 35 wt % or more, more preferably 40 wt % or more of the amphiphilic polymer, or up to or less than 90 wt %, preferably up to or less than 80 wt %, more preferably up to or less than 70 wt % of the amphiphilic polymer, based upon the weight of the final pellet.

Examples of the amphiphilic polymer include, for example, ethylene acrylic acid copolymer (EAA), MAH-grafted ethylene polymer, ethylene methacrylic acid copolymer, vinyl acetate-acrylic acid copolymer, polylactic acid, ethylene-vinyl acetate copolymer (EVA), ethylene-ethyl acrylate copolymer, polyethylene vinyl acetate, polyvinyl acetate, ethylene-methyl methacrylate copolymer, ethylene-butyl acrylate copolymer, their salts or their blends.

In a preferred embodiment, the amphiphilic polymer is ethylene acrylic acid copolymer. "Ethylene acrylic acid copolymer" includes polymers containing ethylene acrylic acid (EAA) or ethylene methylacrylic acid (EMA). Such polymers may be homopolymers (i.e., all EAA or all EMA) or the result of a mixture of EAA and EMA.

In one embodiment, the EAA copolymer comprises 9 wt % or more of acrylic acid units, preferably 15 wt % or more of acrylic acid units, more preferably 18 wt % or more of acrylic acid units, or up to or less than 40 wt % of acrylic acid units, preferably up to or less than 30 wt % of acrylic acid units, more preferably 25 wt % of acrylic acid units. Examples of commercially available ethylene-acrylic acid copolymers include those sold under the tradenames PRIMACOR 5980i, PRIMACOR 5986, and PRIMACOR 5990i, all available from The Dow Chemical Company, and NUCREL 2806, available from E.I. du Pont de Nemours and Company, Inc. Methods of making ethylene-acrylic acid and ethylene-methacrylic acid copolymers are known.

In one embodiment, the pellet contains 30 wt % or more, preferably 35 wt % or more, more preferably 40 wt % or more of EAA copolymer, or up to or less than 90 wt %, preferably up to or less than 80 wt %, more preferably up to or less than 70 wt % of EAA copolymer, based upon the weight of the final pellet.

In another embodiment, the amphiphilic polymer is ethylene-vinyl acetate copolymer (EVA). In one embodiment, the EVA copolymer comprises 5 wt % or more of vinyl acetate units, preferably 10 wt % or more of vinyl acetate units, more preferably 18 wt % or more of vinyl acetate units, or up to or less than 40 wt % of vinyl acetate units, preferably up to or less than 35 wt % of vinyl acetate units, more preferably up to or less than 30 wt % vinyl acetate units. Examples of commercially available ethylene-vinyl acetate copolymers include those sold under tradename ELVAX 265, available from E.I. du Pont de Nemours and Company, Inc. Methods of making ethylene-vinyl acetate copolymers are known.

"Filler" means inert inorganic or organic particles, or combination thereof. Examples of inorganic fillers include, for example, calcium carbonate, sodium carbonate, sodium bicarbonate, sodium percarbonate, magnesium carbonate, white carbon powder, natural zeolite, synthetic zeolite, talc, sodium wallostonite, clay, porous silica, glass bead, absorbent resin, or mixtures. Preferred inorganic filler is calcium carbonate or sodium carbonate. Examples of organic fillers include, for example, melamine polyphosphate. In one embodiment of the invention, the amount of the filler may be 10 wt % or more, preferably 20 wt % or more, more preferably 30 wt % or more, or up to or less than 70 wt %, preferably up to or less than 65 wt %, more preferably up to or less than 60 wt %, based upon the weight of the final pellet. In one embodiment, a portion of the filler is dissolved to increase porosity.

The fabric care pellet may optionally comprise one or more surfactants. The surfactant may comprise anionic, cationic, and/or non-ionic surfactants.

The fabric care pellet may also optionally incorporate one or more stabilizers and/or additives such as, but not limited to, antioxidants (e.g., hindered phenols such as IRGANOX™ 1010 (Ciba/BASF)), thermal (melt processing) stabilizers, hydrolytic stability enhancers, heat stabilizers, acid scavengers, colorants or pigments, UV stabilizers, UV absorbers, nucleating agents, processing aids (such as oils, organic acids such as stearic acid, metal salts of organic acids), antistatic agents, smoke suppressants, anti-dripping agents, tougheners, plasticizers (such as dioctylphthalate or epoxidized soy bean oil), lubricants, emulsifiers, optical brighteners, coupling agents, silanes (in free form or as filler surface modifier), cement, urea, polyalcohols like pentaerythritol, minerals, peroxides, light stabilizers (such as hindered amines), mold release agents, waxes (such as polyethylene waxes), viscosity modifiers, and other additives, to the extent that these additives do not interfere with the desired washing performance of the fabric care pellets of the invention. These additives are used in known amounts and in known ways, but typically the amount of the additive package, if present at all, greater than zero, e.g., 0.01, to 2, more typically 0.1 to 1, even more typically 0.2 to 0.5 wt % of the final pellet.

The pellets may be made by standard means known to those skilled in the art. Examples of compounding equipment include internal batch mixers, e.g., Banbury or Bolling internal mixer. In one embodiment of the invention, continuous single or twin screw mixers can be used, e.g., Farrel continuous mixer, Werner and Pfleiderer twin screw mixer, or Buss kneading continuous extruder. The compounding temperature may vary depending on different type of the amphiphilic polymer or its blends, e.g. for compounding ethylene-acrylic acid copolymer with the filler and optional additive packages is typically 90° C. or more, more typically 120° C. or more, or typically up to or less than 160° C., more typically up to or less than 130° C. The various components to prepare the inventive pellet may be added to and compounded with one another in any order, or simultaneously. The filler and optionally additives may be added as a pre-mixed masterbatch, which are commonly formed by dispersing the filler and optionally additives, either separately or together, into the amphiphilic polymer. Masterbatches are conveniently formed by melt compounding methods.

After compounding, the fabric care pellets may be obtained by underwater pelletizing, strand-cut, water-ring or air-cooling drop. Preferred method of making the fabric care pellets may comprise steps of hot melt extruding the composition of the amphiphilic polymer, the filler and optionally the surfactant, then underwater pelletizing the extrudates.

After extrusion, the fabric care pellets are optionally further treated. Examples of treatments include, for example, UV exposure, washing with water, washing with solvents, or treating with acid or base. Any type of the above treatments may be applied alone or more than one type of treatments may be performed sequentially. If the pellets are treated by solvents, solvents may be removed by traditional means known to those skilled in the art. Examples of the acid compounds include, for example, acetic acid, acrylic acid, lactic acid, formic acid, phosphate acid, hydrochloride acid or mixture thereof, preferably hydrochloride acid. Examples of the basic compounds include, for example, metal hydroxide, methyl amine, metal carbonate (such as sodium carbonate, potassium carbonate, lithium carbonate), metal bicarbonate (sodium bicarbonate, potassium bicarbonate, lithium bicarbonate), metal percarbonate (such as sodium percarbonate, potassium percarbonate) or mixture thereof, preferably, KOH. Further treatment may be used to remove a portion of the filler to increase porosity in some embodiments. In one embodiment, time of the treatment may be 1 hour or more, preferably 5 hours or more, more preferably 12 hours or more, or up to or less than 72 hours, preferably up to or less than 48 hours, more preferably up to or less than 24 hours.

In operation, the fabric care pellets of the invention may be used alone in water or combined with other additives for cleaning fabric. In one embodiment, a detergent may be optionally added. The detergents and the pellets may be added at the same time or separately. The detergents may be blended with the pellets or coated to the pellets of the invention. Examples of the detergents include, for example, powder detergent and/or liquid detergent. The detergent, if present at all, may be added in the weight ratio of the detergent to the fabric, greater than zero, preferably 0.002 or more, or up to or less than 0.02, preferably up to or less than 0.01. As previously mentioned, one of the advantages of the invention is the significant reduction of the detergent usage. The detergent usage of the invention could be reduced by up to or less than 100%, preferably up to or less than 80%, more preferably up to or less than 60% compared to typical detergent usage for the conventional water cleaning process.

Optionally, other cleaning additives known to those skilled in the art may be used with the fabric care pellet, such as, but not limited to, anti-bacterial agents, fragrance, corrosion inhibitors, deodorizers, bleach catalysts, antistatic agents, optical brighteners, ironing adjuvants, anti-microbial active substance, anti-resoil ingredients or mixture thereof. These additives are used in known amounts and in known ways, if present at all, e.g. typically the weight amount of the additives is greater than zero, more typically 0.1% or more, or up to or less than 5%, more typically up to or less than 0.5%, based upon the weight of the pellets.

The weight ratio of the pellets to the fabric may be 0.5 or more, more preferably 0.8 or more, or up to or less than 30, preferably up to or less than 20, more preferably up to or less than 10, most preferably up to or less than 7.

The weight ratio of water to the pellets may be 0.2 or more, preferably 0.5 or more, more preferably 1 or more, or up to or less than 20, preferably up to or less than 10, more preferably up to or less than 5.

In one embodiment, the fabric care pellets are used in the absence of organic solvents. Organic solvents include cyclohexane, hexane, heptane, isooctane, isopentane, pentane, diethyl ether, ethanol, propanol, isopropanol, n-butyl alcohol, t-butyl alcohol, benzyl alcohol, butoxypropanol, acetone, octamethyl cyclo tetrasiloxane, decamethyl cyclopentane siloxane, and mixtures thereof.

In operation, the fabric care pellets contact the fabric. In one embodiment, contact is followed by rinsing and/or centrifugation. Advantageously, the rinsing step may be omitted in some embodiments. Alternatively, steps such as contacting, centrifugation, rinsing and centrifugation sequentially may be employed.

Time and temperatures for different steps employ conventional conditions, e.g. contacting time being 5 minutes or more, preferably 40 minutes or more, or up to or less than 2 hours, preferably up to or less than 1 hours, rinsing time being 1 minute or more, preferably 3 minutes or more, more preferably 5 minutes or more, or up to 1 hour or less, preferably up to 10 minutes or less, centrifugation time being 1 minutes or more, preferably 2 minutes or more, more preferably 5 minutes or more, or up to or less than 1 hour, preferably up to 10 minutes or less, and washing temperatures, e.g. at room temperature or higher, or up to or less than 60° C., or preferably up to or less than 40° C., more preferably up to or less than 35° C. In one embodiment, the fabric care pellets achieve better cleaning at lower temperatures than conventional methods.

In one embodiment, the present invention includes a method of conserving water when laundering fabrics, comprising contacting the fabric with the fabric care pellets. In one embodiment, the weight ratio of water to the fabric loaded in a washing machine is from 2:1 or more, preferably 4:1 or more, or up to or less than 12:1, preferably up to or less than 11:1, more preferably up to or less than 10:1. One of the advantages of the invention is the volumes of water required are significant lower than those associated with the use of the conventional water cleaning process. In one embodiment, the water needed to achieve acceptable cleaning is reduced by at least 50% or more, preferably 60% or more, or more preferably 70% or more compared to 20 liters of water per 1 kg textile typically used in conventional water cleaning processes.

In one embodiment, the fabric care pellets can be used for multiple cleaning cycles over a period of time.

In one embodiment, the fabric care pellets can be treated to regain their efficacy once their cleaning performance begins to lag, for example, treated to remove soil build-up on the pellets.

The following examples are illustrative of the invented compositions and method but are not intended to limit its scope.

EXAMPLES

The following examples illustrate the present invention but are not intended to limit the scope of the invention.

Example 1

Pellets of the invention based on formulations shown in Table 1, were extrusion compounded in a Leiteiz 28 co-rotating intermeshing twin screw extruder.

TABLE 1

Formulations and properties of the fabric care pellets of the invention

| Materials and properties | P-1 | P-2 | P-3 | P-4 |
|---|---|---|---|---|
| EAA (g) | 5000 | 5000 | 5000 | 0 |
| EVA (g) | 0 | 0 | 0 | 5000 |
| Sodium Dodecy BF (g) | 25 | 50 | 10 | 0 |
| Absorbent resin D101 (g) | / | 150 | 100 | / |
| White Carbon (g) | 20 | 20 | 40 | 10 |
| $CaCO_3$ (g) | 4000 | 5000 | 6000 | 4500 |
| Melamine Polyphosphate (g) | 2 | 2 | 2 | 3 |
| IRGAFOS 168 (g) | 5 | 5 | 5 | 5 |
| Porous Silica (g) | 5 | / | 5 | / |
| Zeolite (g) | / | 5 | / | / |
| Density* ($g/cm^3$) | 0.793 | 1.02 | 1.24 | 0.95 |
| Particle Size (diameter in mm) | 3.9 | 2.7 | 2.1 | 2.3 |

*Density of the pellets was measured by AccuPyc 1340 II Pycnometer. The AccuPyc works by measuring the amount of displaced gas, allowing computation of the sample solid phase volume in a conventional manner.

The extruder has 12 temperature control zones including a die. The die is a 2-hole 3.2 mm standard die. The extrudates were cooled through a 4.0 m long water bath, then cut into pellets using a SGS 50-E strand pelletizer. Alternatively, a GALA underwater pelletizer could be used for pellets preparation.

The materials are dried or otherwise treated, if at all, as described.

- EAA is PRIMACOR 5980i copolymer (20.5 wt % acrylic acid), which has a melt index of 300 g/10 minute (ASTM Method D-1238 at 190° C./2.16 kg), available from The Dow Chemical Company.
- EVA is ELVAX 265 (28 wt % vinyl acetate comonomer content), which has melt index of 3 g/10 minute (ASTM Method D-1238 at 190° C./2.16 kg), available from DuPont.
- Sodium Dodecy BF (Sodium dodecyl sulfate) available from Sinopharm Chemical Reagent Co., Ltd
- Absorbent resin D101 available from Sinopharm Chemical Reagent Co., Ltd
- White carbon powder, average particle size around 2 micron available from Degussa
- Calcium Carbonate (average particle size around 15 micron) available from Sinopharm Chemical Reagent Co., Ltd
- Melamine Polyphosphate available from Sinopharm Chemical Reagent Co., Ltd Porous Silica available from Degussa IRGAFOS 168 available from BASF Zeolite available from Sinopharm Chemical Reagent Co., Ltd About 1000 g pellets of the invention obtained from the compounding process were added into 10 L water. Hydrochloric acid was then added to form a solution with pH value in the range of 1-2. The pellets were soaked in the solution for 5-6 hours, followed by water washing and drying in an oven at temperature around 45° C.

Example 2

Using pellets prepared substantially according to the protocol of Example 1, the following investigations are undertaken with 1 kg samples (results will be described in Table 2). The 1 kg textile samples comprise 36 pieces of 6*6 $cm^2$ GB standard soiled samples (12 pieces each for GB standard soiled samples from China Research Institute of Daily Chemical Industry, including JB-01 (carbon black oil), JB-02 (protein) and JB-03 (sebum)) with the balance GB standard textile (GB standard textile from China Research Institute of Daily Chemical Industry) to reach 1 kg. The 1 kg textile samples are loaded into a commercial washer for cleaning tests. The samples after washing are dried before the washing performance evaluation.

IE-1

1 kg textile samples, 5 grams of detergents (Tide from P&G), 2.4 liters of water and 3 kg P-1 pellets are added into a drum washer and washed for 40 minutes at room temperature. The pellets are separated from the textile and the textile is dehydrated by centrifugation for 5 minutes. Then the textile samples are rinsed for 5 minutes using 2 liters of water, and through final centrifugation for 5 minutes and dried. The pellets after using are cleaned only by a centrifugation step for 5 minutes and become reusable for next washing.

IE-2

1 kg textile samples, 3.6 liters of water and 3 kg P-1 pellets are added into a drum washer and washed for 40 minutes at room temperature. The textile samples are washed without detergent. The pellets are separated from the textile and the textile is dehydrated by centrifugation for 5 minutes. Then the textile samples are rinsed for 5 minutes using 2 liters of water, and through final centrifugation for 5 minutes and dried.

IE-3

1 kg textile samples, 5 grams of detergents (Tide from P&G), 3.6 liters of water and 3 kg P-2 pellets are added into a drum washer and washed for 40 minutes at room temperature. The pellets are separated from the textile and the textile is dehydrated by centrifugation for 5 minutes. Then the textile samples are rinsed for 5 minutes using 2 liters of water, and through final centrifugation for 5 minutes and dried.

IE-4

1 kg textile samples, 5 grams of detergents (Tide from P&G), 3.6 liters of water and 3 kg P-3 pellets are added into a drum washer and washed for 40 minutes at room temperature. The pellets are separated from the textile and the textile is dehydrated by centrifugation for 5 minutes. Then the textile samples are rinsed for 5 minutes using 2 liters of water, and through final centrifugation for 5 minutes and dried.

IE-5

1 kg textile samples, 10 grams of detergents (Tide from P&G), 2.4 liters of water and 1 kg P-2 pellets are added into a drum washer and washed for 40 minutes at room temperature. The pellets are then separated from the textile and the textile is dehydrated by centrifugation for 5 minutes. Then the textile samples were rinsed for 5 minutes using 2 liters of water, and through final centrifugation for 5 minutes and dried.

IE-6

1 kg textile samples, 5 grams of detergents (Tide from P&G), 3.6 liters of water and 5 kg P-3 pellets are added into a drum washer and washed for 40 minutes at room temperature. The pellets are separated from the textile and the textile is dehydrated by centrifugation for 5 minutes. Then the textile samples are rinsed for 5 minutes using 2 liters of water, through final centrifugation for 5 minutes and dried.

IE-7

1 kg textile samples, 5 grams of detergents (Tide from P&G), 2.4 liters of water and 3 kg P-4 pellets are added into a drum washer and washed for 40 minutes at room temperature. The pellets are separated from the textile and the textile is dehydrated by centrifugation for 5 minutes. Then the textile samples are rinsed for 5 minutes using 2 liters of water, through final centrifugation for 5 minutes and dried.

Example 3 (Comparative)

To compare performance to known standards, the following comparative studies were undertaken. 1 kg textile samples are prepared comprising 6*6 $cm^2$ GB standard soiled samples (12 pieces each for GB standard soiled samples from China Research Institute of Daily Chemical Industry, including JB-01 (carbon black oil), JB-02 (protein) and JB-03 (sebum)) with the balance GB standard textile (GB standard textile from China Research Institute of Daily Chemical Industry) to reach 1 kg. The 1 kg textile samples are loaded into a commercial washer for cleaning tests. The samples after washing are dried before the washing performance evaluation.

Conventional Cleaning 1 (Room Temperature)

1 kg textile samples, 12 grams of detergents (Tide from P&G) and 6 liters of water were added into a drum washer. The textile samples were washed for 40 minutes at room temperature, then followed the inherent protocols of the washer including centrifugation for 5 minutes, rinsing for 5 minutes using 7 liters of water, another centrifugation for 5 minutes, final rinsing for 5 minutes using 7 liters of water and final centrifugation for 5 minutes. Washing conditions and performances are listed in Table 2.

Conventional Cleaning 2 (Hot Water)

Conventional cleaning 2 was conducted as in Conventional cleaning 1 except the textile samples were washed for 40 minutes at 60° C. Washing conditions and performances are listed in Table 2.

Conventional Agitation with Nylon Pellets 1 kg textile samples, 5 grams of detergents (Tide from P&G), 2.4 liters of water and 3 kg Nylon pellets (Nylon 6,6 available from Shanghai Sailulu Ltd) were added into a drum washer and washed for 40 minutes at room temperature. The pellets were separated from the textile and the textile was dehydrated by centrifugation for 5 minutes. Then the textile samples were rinsed for 5 minutes using 2 liters of water, through final centrifugation for 5 minutes and dried. Washing conditions and performances are listed in Table 2.

Example 4

To evaluate washing performance of inventive Example 2 versus comparative Example 3, a reflectrometer is used to measure Y reflectance of clean textile and soiled textile according to GBT 13174-2008. Before measurement, the reflectometer is calibrated by means of standard vitreous enamel plaques having reflectance ranging from 0 to 92.58, which covers the range of the GB standard textile and GB standard soiled samples being measured. Reflectance of measuring background is in the range of 76~78.

Detergency performance is evaluated according to GBT 13174-2008. Each GB standard soiled sample was measured before washing, and after washing and drying. Detergency of each type of GB standard soiled samples ($R_{JB-N}$) is defined: $R_{JB-N}=\Sigma(Y_{2i}-Y_{1i})/n$; N=01, 02, 03, where $Y_{1i}$ is reflectance of GB standard soiled samples before washing and $Y_{2i}$ is reflectance of GB standard soiled samples after washing and drying; i is the sequential number of GB standard soiled samples and n is the total piece number of the GB standard soiled samples (n=12 for all examples). Sum R (detergenty) is defined as the sum of $R_{JB-01}$, $R_{JB-02}$ and $R_{JB-03}$. High value of Sum R (detergency) indicates better washing performance.

Anti-cross-color performance is evaluated according to GBT 13174-2008. Nine random spots on 500 g GB standard textile were measured before washing, and after washing and drying. $R_{loading}$ is defined as evaluation of anti-cross-color performance: $R_{loading}=\Sigma(Y_{2j}-Y_{1j})/n$; where $Y_{1j}$ is reflectance of GB standard textile before washing and $Y_{2j}$ is reflectance of GB standard textile after washing and drying; j is the sequential number of the spots measured and n is the total number of the spots (n=9 for all examples). High value of $R_{loading}$ indicates better anti-cross-color performance. Residual alkalinity of chemicals on fabric is evaluated according to GB standard BGT 4288-2008. According to the standard, residual alkalinity should be lower than $0.06*10^{-2}$ mol/l.

The results are given in Table 2:

TABLE 2

Cleaning conditions and performance (1 kg textile substrate)

| Cleaning Conditions & Performances | Comparative Conventional Cleaning 1 | Comparative Conventional Cleaning 2 | Comparative Conventional Agitation with Nylon Pellets | IE-1 | IE-2 | IE-3 | IE-4 | IE-5 | IE-6 | IE-7 |
|---|---|---|---|---|---|---|---|---|---|---|
| Temperature (° C.) | 20 | 60 | 20 | 20 | 20 | 20 | 20 | 20 | 20 | 20 |
| Washing water (kg) | 6 | 6 | 2.4 | 2.4 | 3.6 | 3.6 | 3.6 | 2.4 | 3.6 | 2.4 |
| $1^{st}$ Rinsing cycle water amount (kg) | 7 | 7 | 2 | 2 | 2 | 2 | 2 | 2 | 2 | 2 |
| $2^{nd}$ Rinsing cycle water amount (kg) | 7 | 7 | 0 | 0 | 0 | 0 | 0 | 0 | 0 | 0 |
| Total water consumption (kg) | 20 | 20 | 4.4 | 4.4 | 5.6 | 5.6 | 5.6 | 4.4 | 5.6 | 4.4 |
| Pellet loading (kg) | 0 | 0 | 3 | 3 | 3 | 3 | 3 | 1 | 5 | 3 |
| Detergent loading (kg) | 0.012 | 0.012 | 0.005 | 0.005 | 0 | 0.005 | 0.005 | 0.01 | 0.005 | 0.005 |
| Pellet formulation | NA | NA | Nylon | P-1 | P-1 | P-2 | P-3 | P-2 | P-3 | P-4 |
| Water saving compared to conventional cleaning (%) | 0 | 0 | 78.0 | 78.0 | 72.0 | 72.0 | 72.0 | 78.0 | 72.0 | 78.0 |
| Detergent saving compared to conventional cleaning (%) | 0 | 0 | 58.3 | 58.3 | 100.0 | 58.3 | 58.3 | 16.7 | 58.3 | 58.3 |
| $R_{JB-01}$ | 15.4 | 22.1 | 23.4 | 24.0 | 24.1 | 17.9 | 26.7 | 17.2 | 23.5 | 17.2 |
| $R_{JB-02}$ | 4.7 | 9.7 | 4.6 | 23.4 | 5.7 | 10.2 | 21.6 | 23.3 | 20.6 | 10 |
| $R_{JB-03}$ | 8.1 | 9.9 | 10.2 | 26.7 | 21.9 | 13.4 | 31.6 | 17 | 17.7 | 12.4 |
| Sum R (detergency) | 28.2 | 41.7 | 38.2 | 74.1 | 51.7 | 41.5 | 79.9 | 57.5 | 61.8 | 39.6 |
| $R_{loading}$ | −1.1 | −1.7 | −2 | −1.8 | −1.3 | −2.1 | −1.9 | −1.8 | −3.6 | −1.1 |
| Residual alkalinity on textile ($10^{-2}$ mol/l) | 0.009 | 0.011 | 0.057 | 0.024 | 0.015 | 0.002 | 0.013 | 0.048 | 0.025 | 0.002 |

As listed in Table 2, IE-1 saved 78% of water and 58.3% of the detergent compared to the conventional cleaning 1 and 2 samples. Sum R (detergency) of the IE-1 is much better than the conventional cleaning 1 and 2 samples, as shown in Table 2. $R_{loading}$ value was −1.8, which is comparable to the conventional cleaning 1 and 2 samples. Residual Alkalinity ($0.024*10^{-2}$ mol/l) passed the GB BGT 4288-2008 test ($0.06*10^{-2}$ mol/l).

IE-2 saved 72% of water and 100% of the detergent compared to the conventional cleaning 1 and 2 samples. Sum R (detergency) of the IE-2 is much better than the conventional cleaning 1 and 2 samples, as shown in Table 2. $R_{loading}$ is comparable to the conventional cleaning 1 and 2 samples. Residual alkalinity passed the GB BGT 4288-2008 test.

IE-3 saved 72% of water and 58.3% of the detergent compared to the conventional cleaning 1 and 2 samples. Sum R (detergency) of the IE-3 is much better than the conventional cleaning 1 sample and comparable to the conventional cleaning 2 sample, as shown in Table 2. $R_{loading}$ is comparable to the conventional cleaning 1 and 2 samples. Residual alkalinity passed the GB BGT 4288-2008 test.

IE-4 saved 72% of water and 58.3% of the detergent compared to the conventional cleaning 1 and 2 samples. Sum R (detergency) of the IE-4 is much better than the conventional cleaning 1 and 2 samples, as shown in Table 2. $R_{loading}$ is comparable to the conventional cleaning 1 and 2 samples. Residual alkalinity passed the GB BGT 4288-2008 test.

IE-5 saved 78% of water and 16.7% of the detergent compared to the conventional cleaning 1 and 2 samples. Sum R (detergency) of the IE-5 is much better than the conventional cleanings 1 and 2 samples, as shown in Table 2. $R_{loading}$ is comparable to the conventional cleaning 1 and 2 samples. Residual alkalinity passed the GB BGT 4288-2008 test.

IE-6 saved 72% of water and 58.3% of the detergent compared to the conventional cleaning 1 and 2 samples. Sum R (detergency) of the IE-6 is much better than the conventional cleaning 1 and 2 samples, as shown in Table 2. $R_{loading}$ is slightly lower compared to the conventional cleaning 1 and 2 samples. Residual alkalinity passed the GB BGT 4288-2008 test.

IE-7 saved 78% of water and 58.3% of the detergent compared to the conventional cleaning 1 and 2 samples. Sum R (detergency) of the IE-7 is much better than the conventional cleaning 1 sample and slightly lower than the conventional cleaning 2 sample, as shown in Table 2. $R_{loading}$ is comparable to the conventional cleaning 1 and 2 samples. Residual alkalinity passed the GB BGT 4288-2008 test.

The present invention may be embodied in other forms without departing from the spirit and the essential attributes thereof, and, accordingly, reference should be made to the appended claims, rather than to the foregoing specification, as indicating the scope of the invention.

The invention claimed is:

1. A fabric care pellet, comprising:

an amphiphilic polymer selected from ethylene acrylic acid copolymer and salts thereof;

a surfactant; and a filler, wherein the pellet contains 30% to 90% by weight of the amphiphilic polymer, based upon the weight of the pellet;

wherein the fabric care pellet does not contain a fragrance.

2. The fabric care pellet of claim 1, wherein the filler is selected from the group consisting of talc, sodium wallostonite, clay, calcium carbonate, porous silica, glass beads, zeolites, melamine polyphosphate and mixtures thereof.

3. The fabric care pellet of claim 1, wherein the pellet comprises from 10% to 70% by weight filler based upon the weight of the pellet.

4. The fabric care pellet of claim 1, wherein the pellet has porous structure.

5. The fabric care pellet of claim 1, wherein the pellet has a density from 0.7 g/cm$^3$ to 1.5 g/cm$^3$.

6. A method of cleaning fabric, comprising contacting the fabric with a fabric care pellet according to claim 1.

7. The method of claim 6, wherein the method is carried out in presence of a detergent.

8. The method of claim 6, wherein the weight ratio of the pellet to the fabric is from 0.5:1 to 10:1.

9. The method of claim 6, wherein the method is carried out in presence of water and the weight ratio of water to the fabric is from 2:1 to 11:1.

10. The method of claim 6, wherein the method is carried out in presence of water and the weight ratio of water to the pellet is from 0.2:1 to 20:1.

11. The method of claim 6, wherein the method is carried out in absence of organic solvents.

12. A method of conserving water when laundering fabrics, comprising contacting the fabric with the fabric care pellet of claim 1.

13. The method of claim 12, wherein the method is carried out in presence of a detergent.

14. The method of claim 12, wherein the weight ratio of the pellet to the fabric is from 0.5:1 to 10:1.

15. The method of claim 12, wherein the method is carried out in presence of water and the weight ratio of water to the fabric is from 2:1 to 11:1.

16. A method of making a fabric care pellet, comprising hot melt extruding a composition of an amphiphilic polymer selected from the group consisting of ethylene acrylic acid copolymer and salts thereof; a surfactant; and a filler, wherein the pellet does not contain a fragrance and contains 30% to 90% by weight of the amphiphilic polymer, based upon the weight of the pellet.

* * * * *